US008403302B2

(12) United States Patent
Erel et al.

(10) Patent No.: US 8,403,302 B2
(45) Date of Patent: Mar. 26, 2013

(54) ELEVATED SUPPORT SYSTEM

(75) Inventors: Bulent Erel, Roswell, GA (US); Tareq K. Hassan, Norcross, GA (US); Raymond V. Pagano, Stone Mountain, GA (US); James L. Pfaffenberger, Marietta, GA (US)

(73) Assignee: Videolarm, Inc., Decatur, GA (US)

( * ) Notice: Subject to any disclaimer, the term of this patent is extended or adjusted under 35 U.S.C. 154(b) by 755 days.

(21) Appl. No.: 12/554,248

(22) Filed: Sep. 4, 2009

(65) Prior Publication Data

US 2010/0051767 A1 Mar. 4, 2010

Related U.S. Application Data

(60) Provisional application No. 61/094,305, filed on Sep. 4, 2008, provisional application No. 61/154,463, filed on Feb. 23, 2009.

(51) Int. Cl.
*B66D 1/50* (2006.01)

(52) U.S. Cl. ..... 254/273; 254/271; 254/282; 254/334; 254/335; 254/336; 254/338; 248/205.1

(58) Field of Classification Search ..... 254/271, 254/272, 273, 274, 275, 276, 334, 335, 336, 254/337, 338; 248/205.1
See application file for complete search history.

(56) References Cited

U.S. PATENT DOCUMENTS

| | | | |
|---|---|---|---|
| 1,006,834 | A | 10/1911 | Edwards |
| 1,284,909 | A | 11/1918 | Rose et al. |
| 2,584,713 | A | 2/1952 | Kanaval |
| 2,908,408 | A | 10/1959 | Reed |
| 3,288,412 | A | 11/1966 | Murphy |
| 3,310,899 | A | 3/1967 | Hart et al. |
| 3,579,880 | A | 5/1971 | Murphy |
| 3,610,584 | A | 10/1971 | Pfaff |
| 3,822,051 | A | 7/1974 | Karapita |
| 3,862,734 | A | 1/1975 | Buchin et al. |
| 3,958,116 | A | 5/1976 | Jones |
| 4,025,782 | A | 5/1977 | Kaeser |
| 4,051,525 | A | 9/1977 | Kelly |
| 4,149,230 | A | 4/1979 | Garchinsky |
| 4,173,268 | A | 11/1979 | Nussbaum |
| 4,198,022 | A | 4/1980 | Pletcher et al. |
| 4,593,883 | A | 6/1986 | Nelson |
| 4,618,886 | A | 10/1986 | Mooney |
| 4,656,569 | A | 4/1987 | Buskell |
| 4,658,212 | A | 4/1987 | Ozawa et al. |
| 4,878,160 | A | 10/1989 | Reneau et al. |
| 4,974,134 | A | 11/1990 | Bourne |
| 5,255,882 | A | 10/1993 | Schroppel |
| 5,398,026 | A | 3/1995 | Handsaker |
| 5,406,327 | A | 4/1995 | Guarnotta |

(Continued)

FOREIGN PATENT DOCUMENTS

| | | | |
|---|---|---|---|
| DE | 3101202 | A1 | 11/1982 |
| FR | 2752805 | A1 | 9/1996 |

(Continued)

*Primary Examiner* — Emmanuel M Marcelo
(74) *Attorney, Agent, or Firm* — Gardner Gross Greenwald & Villanueva, PC

(57) ABSTRACT

A system for raising and lowering equipment and including a fixed support arm for attachment to an elevated support structure, a movable carriage for carrying the equipment, a cable extending between the fixed support arm and the movable carriage, and a winch for spooling and unspooling the cable to raise and lower the movable carriage relative to the fixed support arm. A locking mechanism secures the carriage in its raised position, and alignment guides position the carriage to make electrical connections as the carriage is engaged onto the support arm.

19 Claims, 10 Drawing Sheets

U.S. PATENT DOCUMENTS

| | | | | |
|---|---|---|---|---|
| 5,429,519 | A | 7/1995 | Murakami et al. | |
| 5,550,727 | A | 8/1996 | Fenyvesy | |
| 5,647,758 | A | 7/1997 | Ichikawa et al. | |
| 5,743,324 | A | 4/1998 | Kunstreich et al. | |
| 5,887,841 | A | 3/1999 | Newberg | |
| 5,975,726 | A | 11/1999 | Latimer | |
| 6,056,450 | A | 5/2000 | Walling | |
| 6,155,018 | A | 12/2000 | Yang | |
| 6,354,749 | B1 | 3/2002 | Pfaffenberger, II | |
| 6,447,150 | B1 | 9/2002 | Jen et al. | |
| 6,665,968 | B2 | 12/2003 | Jen | |
| 7,004,043 | B2 | 2/2006 | Erel et al. | |
| 7,267,496 | B2 | 9/2007 | Wesselink et al. | |
| 7,303,182 | B2 * | 12/2007 | Ash | 254/336 |
| 7,389,972 | B2 * | 6/2008 | Mathias | 254/275 |
| 7,410,150 | B1 * | 8/2008 | Falls | 254/272 |
| 7,527,243 | B2 * | 5/2009 | Blasek | 254/333 |
| 8,038,125 | B2 * | 10/2011 | Troy et al. | 254/338 |
| 2003/0025791 | A1 | 2/2003 | Kaylor et al. | |
| 2004/0084664 | A1 * | 5/2004 | Ash | 254/338 |
| 2005/0151846 | A1 | 7/2005 | Thornhill | |
| 2005/0279976 | A1 * | 12/2005 | Kohlenberg et al. | 254/274 |
| 2007/0272490 | A1 * | 11/2007 | Blasek | 187/254 |

FOREIGN PATENT DOCUMENTS

| | | | |
|---|---|---|---|
| FR | 2824624 | A1 | 5/2001 |
| WO | 9416267 | | 7/1994 |

* cited by examiner

ELEVATED SUPPORT SYSTEM

CROSS-REFERENCE TO RELATED APPLICATION

This application claims priority benefit to U.S. Provisional Patent Application Ser. No. 61/094,305 filed Sep. 4, 2008 and U.S. Provisional Patent Application Ser. No. 61/154,463 filed Feb. 23, 2009, both of which are hereby incorporated herein by reference in their entireties.

TECHNICAL FIELD

The present invention relates generally to the field of support systems for elevated objects, and more particularly to a system for raising and lowering a surveillance camera and/or other equipment.

BACKGROUND

It is often desirable to position a surveillance camera or other equipment at an elevated height, for example to improve the field of view and/or to prevent vandalism or theft. The present invention provides an improved elevated support system for a surveillance camera or other equipment.

SUMMARY

In example embodiments, the present invention relates to an improved elevated support system for a surveillance camera or other equipment. The elevated support system of the invention allows the supported equipment to be selectively raised and lowered for service and/or to adjust the support position.

In one aspect, the present invention relates to a system for raising and lowering equipment. The system preferably includes a fixed support arm for attachment to an elevated support structure, a movable carriage for carrying the equipment, a cable extending between the fixed support arm and the movable carriage, and a winch for selectively spooling and unspooling the cable to raise and lower the movable carriage relative to the fixed support arm.

In another aspect, the present invention relates to an elevated support mechanism including an upper support member; a carriage movable between a raised position adjacent the upper support member, and a lowered position beneath the upper support member; a lifting system for raising and lowering the carriage; and a locking mechanism for securing the carriage in the raised position.

In another aspect, the present invention relates to an elevated support system for a surveillance camera. The support system preferably includes a support arm having a winch mounted thereto for raising and lowering the surveillance camera, a first upper pulley, an upper electrical contact, and an upper alignment guide member. The support system preferably also includes a carriage for mounting the surveillance camera to, and having at least one lower pulley, a lower electrical contact for cooperative engagement and disengagement with the upper electrical contact of the support arm, and a lower alignment guide member for cooperative engagement and disengagement with the upper alignment guide member. The support system preferably also includes a cable having a first end spooled onto the winch, extending over the first upper pulley, downward and around the at least one lower pulley, and back up to a second end affixed to the support arm.

These and other aspects and features of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary of depicted embodiments, and are not restrictive of the invention as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1B:
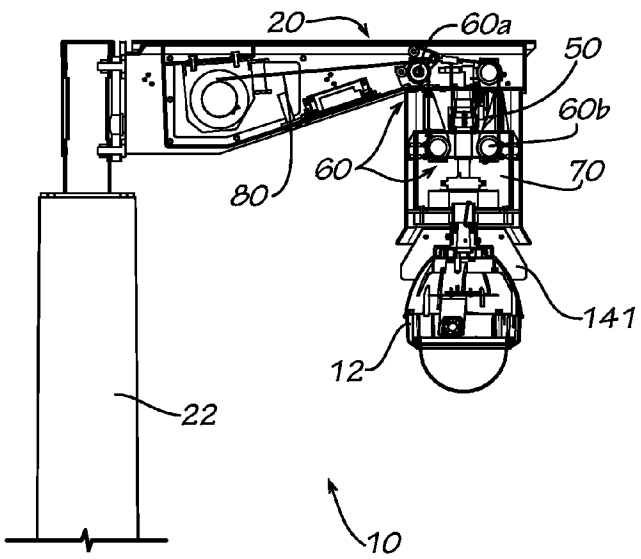
FIGS. 1*a* and 1*b* are cross-sectional side elevation views of an elevated support system according to an example form of the present invention, with the supported object being in a lowered and raised position, respectively.
Figure 1A:
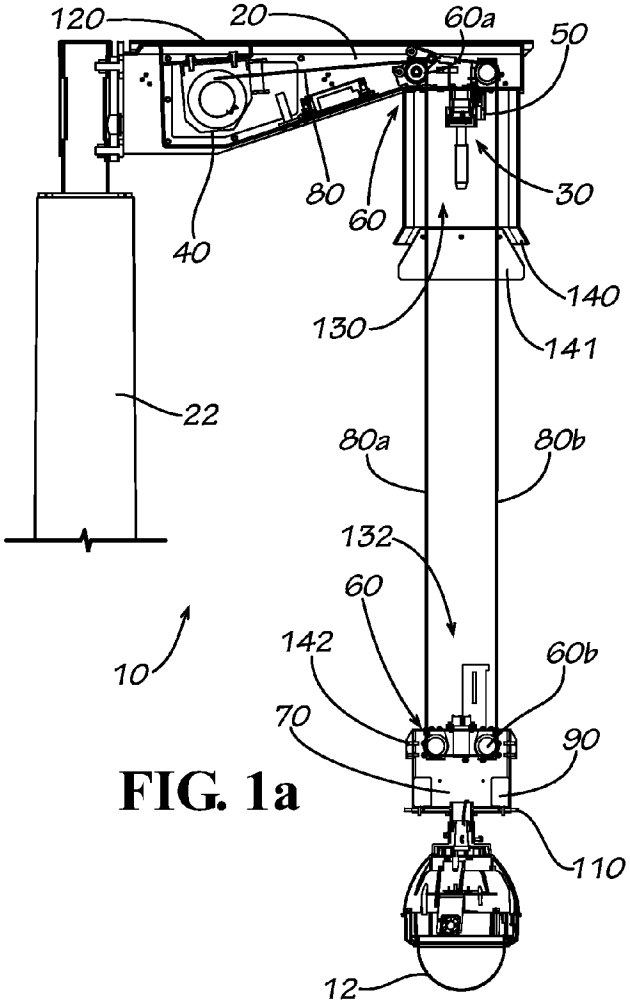
Figure 2:
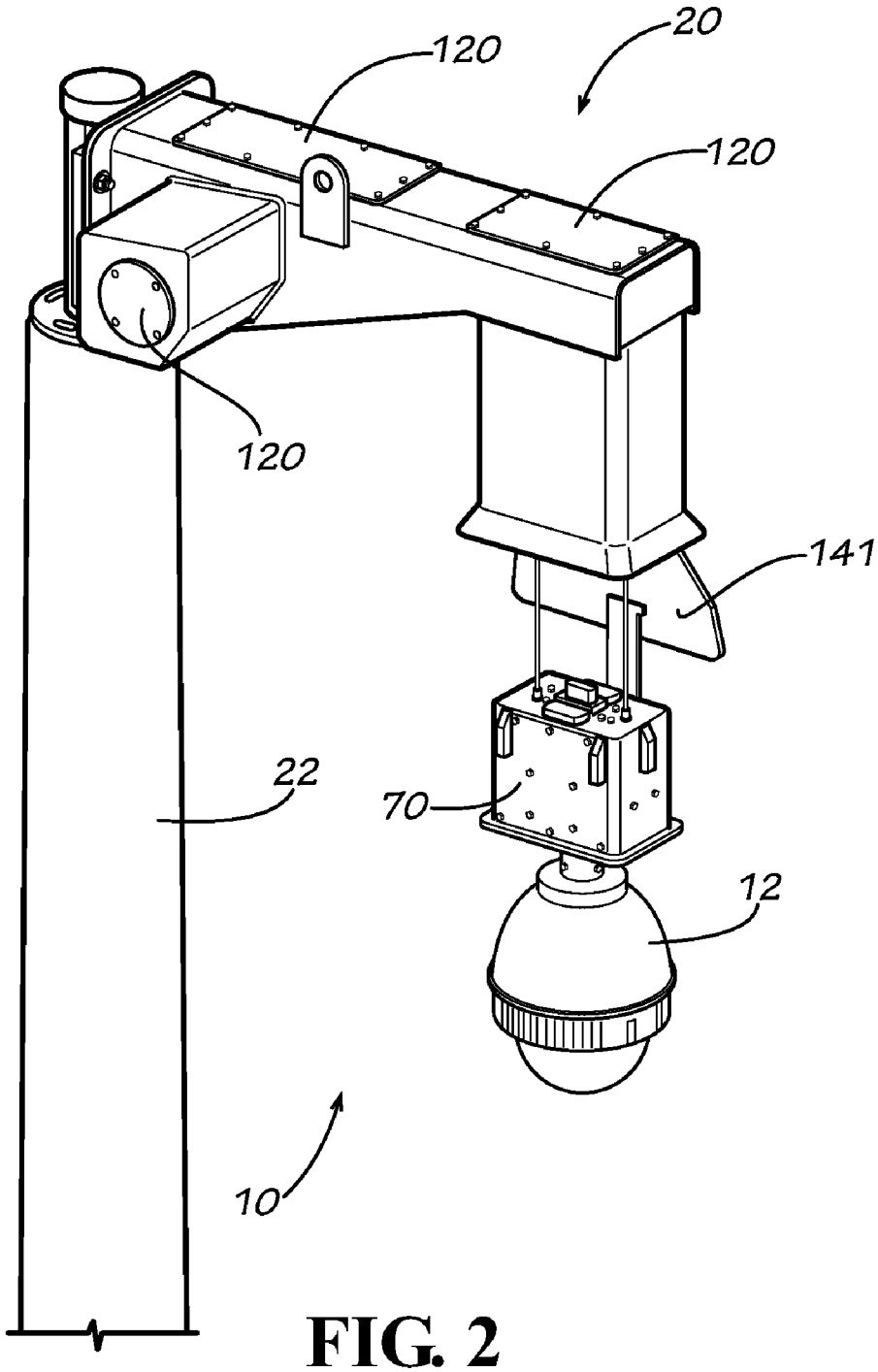
FIG. 2 shows a perspective view of the elevated support system of FIGS. 1*a* and 1*b*, with the support object being in an intermediate position.

With reference now to the drawing figures, wherein like reference numbers represent corresponding parts throughout the several views, FIGS. 1*a*,1*b*, and 2 show an elevated system 10 for raising, lowering and supporting a surveillance camera or other equipment according to an example form of the invention. In the depicted embodiment, a surveillance camera dome housing 12 houses a camera for capturing images for remote observation and/or recording. The camera or other equipment can be selectively raised and supported in an elevated position to provide a better field of view and prevent tampering or vandalism, or lowered for maintenance. The system 10 generally comprises an elevated arm body 20 mounted by brackets, welding, connectors, couplings or other attachment means to the top, side or other portion of a pole 22, or to a building, wall, tower, framing or other elevated support structure.

The arm body 20 preferably encases electronic controller circuitry, power circuitry, power and video connectivity, and other components for transmitting video signals from the camera to a remote viewing and/or recording station, and for delivering power from a remote power source to the camera, associated lighting source(s), and/or the lift equipment. The lift equipment preferably comprises a centering and connecting mechanism 30, a winch 40, a sprocket and latch locking mechanism 50 and a pulley system 60 that supports a movable carriage or junction box 70 to which the camera housing 12 can be secured. The winch 40 preferably comprises an electric motor, optional gearing, and a spool or drum for winding and unwinding the cable or wire 80 used to raise and lower the camera housing 12 and junction box 70. The pulley system 60 preferably includes at least one upper pulley 60*a* (two are depicted) rotationally mounted to the arm body 20, and at least one lower pulley 60*b* (two are depicted) rotationally mounted to the junction box 70.

The system 10 can be activated either manually or automatically. In the automatic/remote version, a control unit is deployed at or near the base of the pole or mounting structure, or at a remote control station, to control the powered winch activity. In the manual version, a manual winch such as a pulley and crank arm mechanism are used in lieu of the powered winch. The junction box 70 preferably has the capacity to house one or more optional weights 90 to ensure appropriate disengagement of the junction box connectors from the centering and connecting mechanism 30. A weather seal 110 is preferably deployed at the base of the junction box 70 to ensure environmental protection of the electronic circuitry during operation. One or more sealed access doors 120 are preferably provided to allow for maintenance access to different parts of the system.

In an example mode of operation, in the top or raised position, as seen in FIG. 1*b*, the latching mechanism 50 locks the junction box 70 in place, to release any tension loading on the system cable 80. In this position, the power and video connection is fully engaged, by coupling of upper electrical contacts 130 in the arm body 20 with lower electrical contacts 132 on the junction box 70, allowing for the proper operation of the security monitoring device mounted in the housing 12. To lower the junction box 70, actuation of a "down" button on the remote device initiates a slight upward motion of the junction box that—deploying a sprocket or ratchet latch system of the locking mechanism 50—disengages and retracts a locking bar or pawl. It then initiates the unwinding of the cable 80 off a spool on the winch 40, lowering the security housing 12 to a lowered position, as seen in FIG. 1*a*, at a level controlled by the operator. The cable 80 preferably comprises a continuous length of cable routed around the pulley system 60 in a loop to define a dual path (i.e., two segments 80*a*, 80*b* of the cable being spaced a distance from one another). This dual path cabling arrangement reduces swaying of the housing 12 and allows for the system to stabilize during the lowering and raising activities and also reduces the possibility of having the system collide with the structure it is mounted to. The cable loop extends from a first end attached and spooled onto the winch 40, generally horizontally across through the arm body 20 and over a proximal upper pulley 60*a* in the arm body, then downward and around a proximal lower pulley 60*b* and a distal lower pulley 60*b* (alternatively a single lower pulley can be utilized) on the junction box 70, then back up to the arm body, and optionally over a distal upper pulley 60*a* to a second end affixed to an overload/unspooling mechanism (described below) or otherwise affixed to the arm body. In alternate embodiments, a single cable path is provided, having a first end of the cable spooled onto the winch 40, a medial segment of the cable passing over a pulley in the upper arm body 20, and a second end of the cable affixed to the junction box 70.

To raise the junction box 70, the "up" button on the remote activates the winch 40 in an opposite direction to retract the cable 80, raising the assembly of the junction box 70 and housing 12. At the top, the centering pins 71 of the centering and connecting mechanism 30 position the junction box 70, engaging contacts 130, 132 of the power and video connection, and a dual sensing and locking action preferably secures the junction box in its raised position. The electrical connection for delivering power and/or video signals to and from the surveillance camera or other supported equipment is made between the one or more upper electrical contacts 130 positioned on a lower face of a carrier or other portion of the support arm body which cooperatively couples with the one or more lower electrical contacts 132 on an upper face of the carriage; and the lower electrical contacts are in turn connected to input and/or output connections of the surveillance camera or other supported equipment mounted to the carriage. An optional LED on the remote unit indicates to the operator that the system is in position and secured. Because the video signal transmission and electrical power transmission cabling and equipment are maintained stationary in the arm body, and are not raised and lowered with the camera housing 12, the potential for tangling with the lift cables is eliminated.

The system 10 preferably comprises cooperating housing alignment components on the arm body 20 and on the junction box 70. For example, the inside periphery of the downward facing receiver of the arm body 20 preferably comprises one or more inwardly tapering wall portions 140 for guiding one or more cooperating tapered outer contact faces 142 about the outside periphery of the junction box 70 into alignment as the housing 12 moves into the raised position. The system also preferably comprises at least one sway plate 141. The sway plate(s) 141 is/are attached to the wall portions 140 and extend downward at an angle therefrom, helping to center the carriage 70 and prevent any swinging of the carriage 70 as it is raised into arm body 20. The contacts 130, 132 optionally also comprise one or more alignment guides for ensuring proper electrical contact.

Figure 3A:
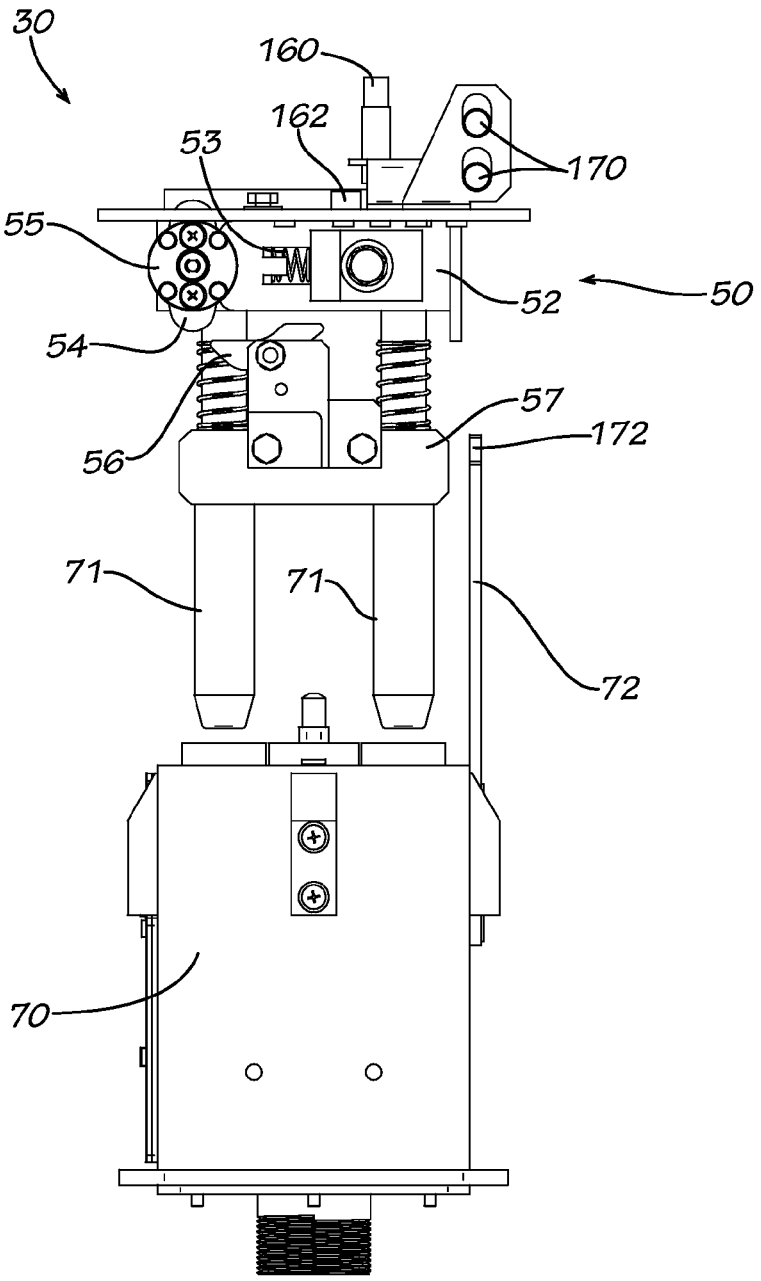
FIGS. 3*a* and 3*b* are detailed views of the alignment and locking mechanisms of the elevated support system according to an example form of the present invention.
Figure 3B:
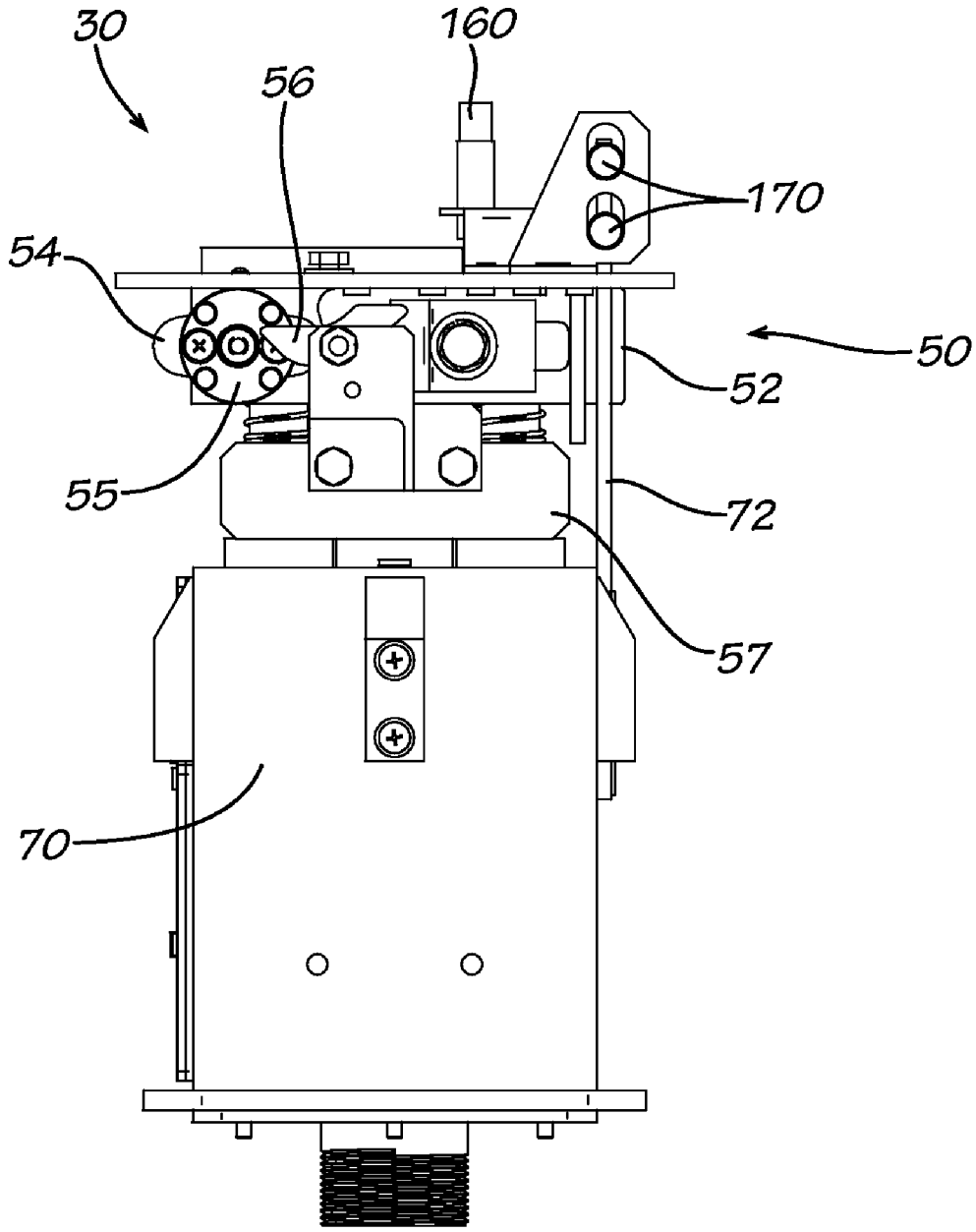

The centering and connecting mechanism 30 and the latch locking mechanism 50 are shown in greater detail in FIGS. 3*a* and 3*b*. The latch mechanism 50 is affixed by bolts, welding or other attachment means to the arm body 20 at the top of the pole 22, and the alignment pins 71 of the centering mechanism 30 extend downwardly therefrom. The latch mechanism 50 includes a transversely sliding locking plate 52 that engages within a slot in a locking arm 72 extending from the carriage 70 to hold the carriage at its raised position. A retraction spring 53 normally biases the locking plate 52 away from engagement with the carriage locking arm 72, as shown in FIG. 3*a*. An oblong or elliptical cam 54 advances the locking plate 52 into engagement with the carriage locking arm 72, overcoming the spring bias, when actuated, as shown in FIG. 3*b*.

The cam 54 is rotationally actuated by rotation of an indexing wheel 55 affixed to the cam by a pawl 56 that is pivotally mounted to a carrier 57 that is slidably carried on the alignment pins 71 of the centering mechanism. In relation to the views represented in FIGS. 3*a* and 3*b*, the pawl 56 is free to partially rotate in a clockwise direction, while being blocked from rotating in a counter-clockwise direction, thereby acting as a ratchet to turn the indexing wheel 55 in one direction (counterclockwise) only. The pawl 56 engages one of four actuator pins on the indexing wheel 55 to advance the actuating wheel, and thus the cam 54, by sequential 90° increments with each actuation. As the carriage 70 is lifted into its raised position by the winch 40 reeling in the cable 80, the carriage contacts the carrier 57, lifting it against the bias of one or more return springs engaged between the carrier and the latch mechanism 50. As the carriage is driven upwards, the pawl 56 rotates the indexing wheel 55 and the cam 54 by 90°. Rotation of one of two diametrically opposed lobes of the cam 54 into abutment with the locking plate 52 advances the locking plate transversely (generally perpendicular to the raising and lowering of the carriage) through the slot in the carriage locking arm 72. Upon release of tension on the cable 80, the engagement of the locking plate 52 in the slot of the carriage locking arm holds the carriage 70 in its raised position (FIG. 3*b*).

To lower the carriage 70, the winch 40 is actuated to retract the cable 80 and raise the carriage 70 slightly, which in turn contacts and lifts the carrier 57, causing the pawl 56 to engage one of the pins on the indexing wheel 55 and rotate the indexing wheel and cam 54 by another 90° increment, allowing the retraction spring 53 to retract the locking plate 52 from the slot of the carriage locking arm 72. This releases the carriage 70 and allows it to be lowered (FIG. 3*a*). The return springs on the alignment pins, between the carrier 57 and the latch mechanism 50, then push the carriage downwardly, disconnecting the electrical contacts 130, 132 as the winch 40 reels out cable 80 to lower the carriage 70. Since the pawl 56 is free to rotate in the clockwise direction (in the reference frame of FIGS. 3*a* and 3*b*), it toggles and does not rotate the pins on the indexing wheel 55 as the carriage 70 is lowered. The slot in the carriage locking arm 72 is preferably slightly longer, for example about 1" longer, than the height of the locking plate 52 to allow the carriage to be raised a distance sufficient to cause the pawl 56 to actuate the indexing wheel 55.

The system 10 optionally also comprises one or more position and/or load sensors, and/or electronic and/or software implemented control systems. For example, a locking plate position sensor 160 senses the presence or absence of a projection or indicator portion 162, shown in FIG. 3*a* but hidden in FIG. 3*b*, of the locking plate 52 to identify the position of the locking plate 52 as either locked (engaged), as shown in FIG. 3*b*, or unlocked (disengaged), as shown in FIG. 3*a*. At least one locking arm up-down position sensor 170 (two are shown) similarly senses the presence or absence of a projection or indicator portion 172 of the carriage locking arm 72 to indicate when the carriage has been raised to its topmost position. An end-of-cable sensor is optionally provided in the winch compartment to prevent the cable from running off the spool and dropping the junction box (as described in further detail below). The sensors preferably communicate signals via wired or wireless connection to a processor, such as a remote or onboard microprocessor or computer programmed with software code for implementing the operation of the system.

For example, when the user pushes an "up" button or otherwise actuates the device to raise the carriage 70 and camera or other equipment mounted thereto, the winch 40 is actuated by a controller to reel in cable 80, thereby raising the carriage toward the arm body 20. As the carriage 70 reaches the raised position, the alignment pins guide the carriage into position to connect the electrical contacts 130, 132. The carriage 70 lifts the carrier 57 of the locking mechanism 50, causing the pawl 56 to engage the indexing wheel 55 and rotate the cam 54, thereby engaging the locking plate 52 into the slot of the carriage locking arm 72. The locking arm up-down position sensor 170 senses the presence of the indicator portion 172 of the carriage locking arm 72, to signal that the carriage has been raised to its uppermost position, causing the winch controller to stop the winch. The locking plate position sensor 160 confirms that the locking plate is engaged, whereupon the winch 40 is briefly reversed to allow the carriage to lower slightly into a raised resting position until its weight is borne by the locking mechanism and tension on the cable 80 is released. The positioning of the carriage at this stage can be controlled by a position sensor, a load sensor, or by timing of the duration of the reverse operation of the winch. The carriage is thereby secured in the raised position for normal operation.

To lower the carriage and associated equipment for service or inspection, the user pushes a "down" button or otherwise actuates the device to lower the carriage 70. Initially, the winch controller reels in the cable to raise the carriage slightly, lifting the carrier 57 of the locking mechanism 50, and causing the pawl 56 to engage the indexing wheel 55 and rotate the cam 54, thereby disengaging the locking plate 52 from the slot of the carriage locking arm 72. The locking arm up-down position sensor 170 senses the presence of the indicator portion 172 of the carriage locking arm 72, to signal that the carriage has been raised to its uppermost position, causing the winch controller to stop the winch. The locking plate position sensor 160 confirms that the locking plate is now disengaged, whereupon the winch 40 is reversed to reel out the cable and lower the carriage back down to its lowered position.

Figure 6:
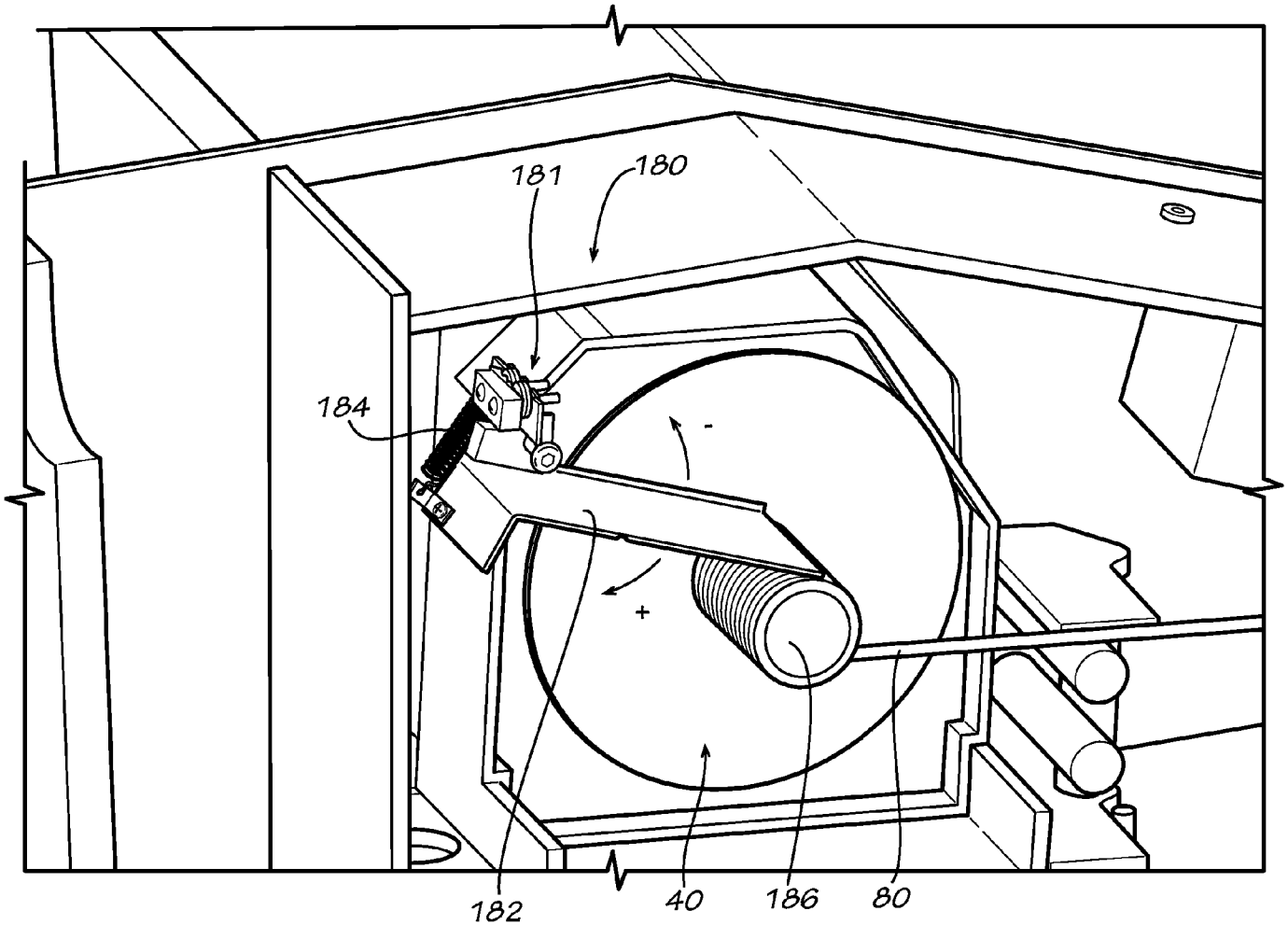
FIG. 6 shows a cutaway perspective view of an optional end-of-spool sensor shutoff mechanism, according to an example form of the invention.

As shown in FIG. 6, an end-of-spool sensor mechanism 180 is optionally provided with the winch 40. The end-of-spool sensor mechanism 180 includes a pivotally mounted arm 182 biased by a spring 184 into contact with the outer periphery of the cable 80 coiled on a spool 186 of the winch 40. As the spool 186 unwinds cable during lowering of the camera housing, the diameter of the outer periphery of the cable coil decreases, allowing the free end of the arm 182 to pivot in a first direction toward the core of the spool 186 (indicated as "+" in the figure); whereas when the winch takes the cable back up during raising of the camera housing, the diameter of the outer periphery of the cable coil increases, forcing the arm 182 to pivot against the bias of the spring 184 in a second direction away from the core of the spool 186 (indicated as "–" in the figure). One or more contacts positioned on the pivoting arm actuate a switch or sensor 181 as the cable is almost entirely unwound, shutting off the winch to prevent unwinding the cable entirely off of the spool. The sensor mechanism 181 ensures that the cable 80, which wraps around the spool 186, does not entirely run off the spool 186, which could cause the carriage/camera housing assembly 70 to fall to the ground.

Figure 4:
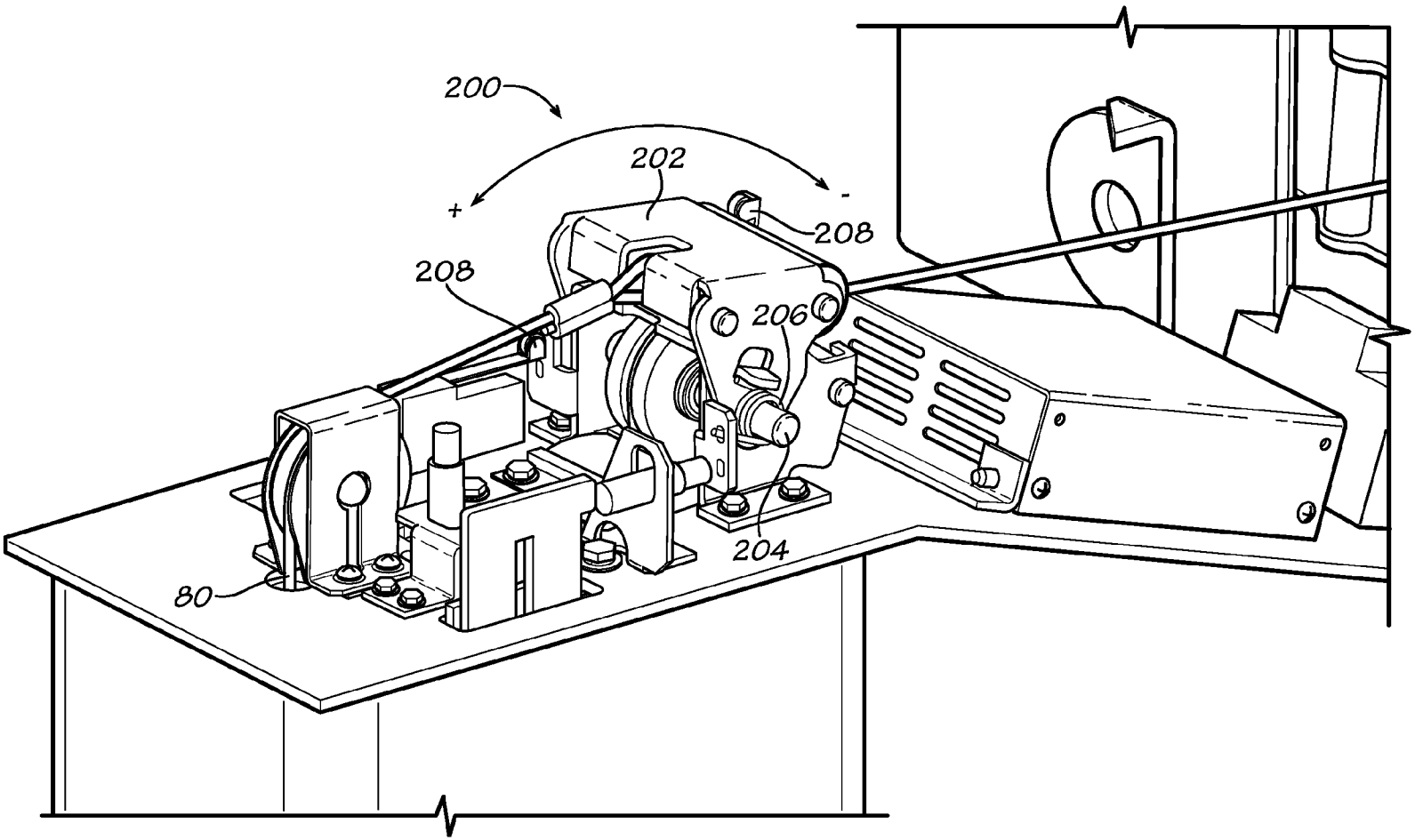
FIG. 4 is a perspective view of an overload/unspooling shutoff mechanism portion of the elevated support system of FIGS. 1*a* and 1*b*.
Figure 5:
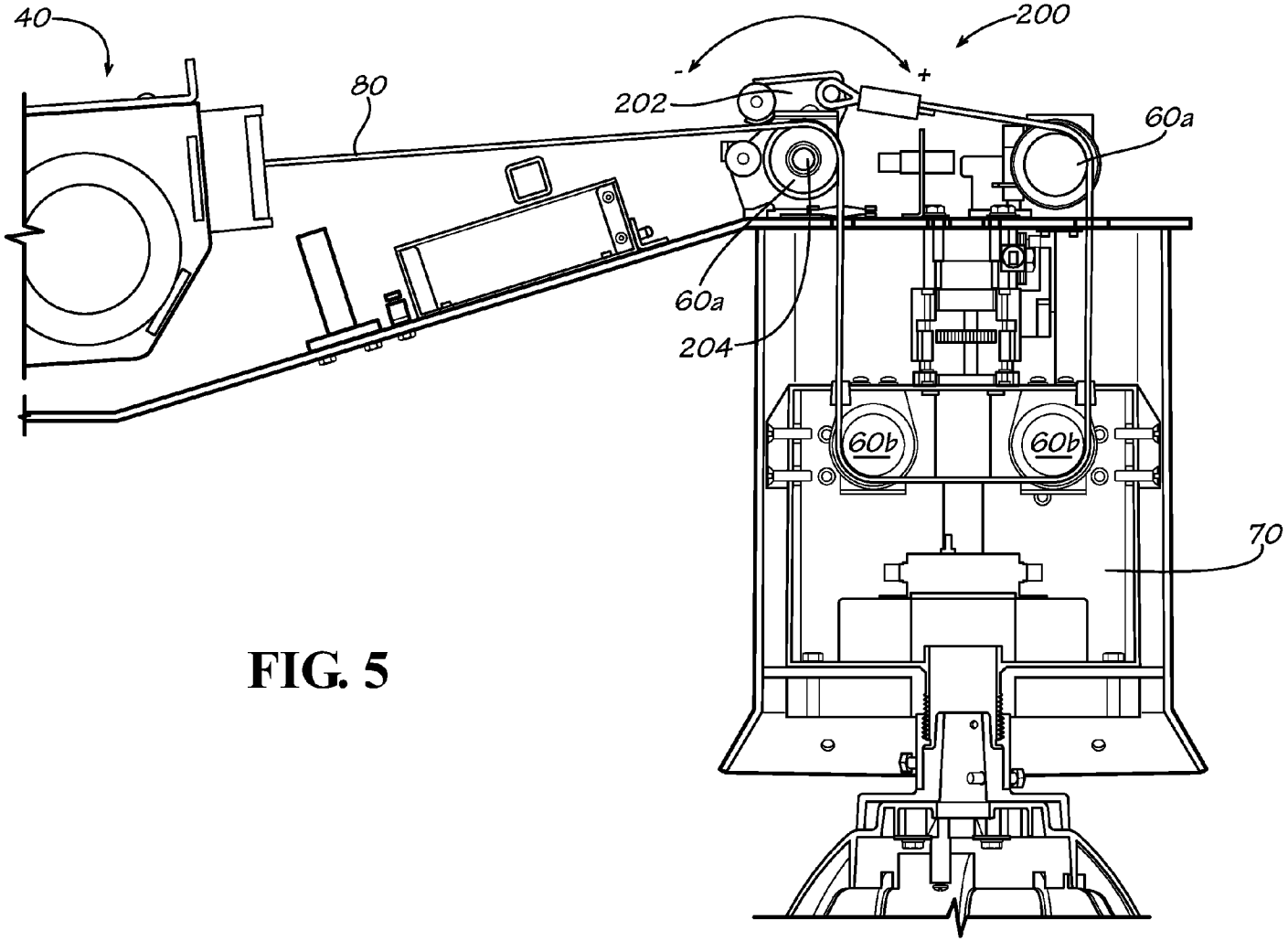
FIG. 5 is a detailed side cross-sectional view of the elevated support system of FIGS. 1*a* and 1*b*.

FIGS. 4 and 5 show an overload/unspooling mechanism 200 that is optionally provided on the system of the present invention. The overload/unspooling mechanism 200 may serve one or both of two functions: first, to prevent overloading and damaging the winch motor in the event the camera housing becomes entangled with other objects during raising; and/or second, to prevent unspooling and tangling of the cable if the camera housing is stopped or lifted during lowering. The overload/unspooling mechanism 200 comprises a bracket 202 pivotally mounted about an axle 204 (optionally the same axle that the upper pulley 60*a* is rotationally mounted on), one or more torsion spring(s) 206 for retaining the bracket in position during operation and setting the overload/unspooling force that triggers shutdown, and one or more sensors or switches 208 for controlling the operation of the winch motor in response to the pivotal position of the bracket. The distal end of the cable 80 is affixed to the bracket 202, with the proximal end of the cable spooled on the winch, and the intermediate portion of the cable traversing the lower pulleys 60*b* and the upper pulleys 60*a* to raise and lower the camera housing as the winch spools and unspools the cable.

The spring stiffness of the torsion spring(s) 206 of the overload/unspooling mechanism 200 is/are selected to effectively counterbalance the weight of the camera housing and junction box, as well as any other equipment intended to be raised and lowered with the camera housing, to retain the bracket 202 in a neutral position (as shown in the figures). In the event too much force (i.e., greater than the anticipated maximum force) is applied to the cable 80 during raising or lowering (indicating the camera housing may have snagged on an obstruction during raising or something unintended is hanging on the camera housing during lowering), that force will overcome the bias of the retaining spring(s), causing the bracket 202 to pivot in a first direction (indicated as "+" in the figures), and actuating a sensor or switch 208 to shut down the winch motor to prevent overload damage to the winch motor and/or structural damage to the arm body, cable, or other components. In the event that less than the anticipated minimum force is applied to the cable 80 during raising or lowering (indicating the camera housing may have snagged on an obstruction during lowering, or is being lifted by a worker), the force applied by the torsion spring(s) 206 will overcome the force applied by the cable 80, causing the bracket 202 to pivot in an opposite second direction (indicated as "−" in the figures), also actuating a sensor or switch 208 to shut down the winch motor to prevent loose unspooling and potential tangling of the cable.

Figure 7:
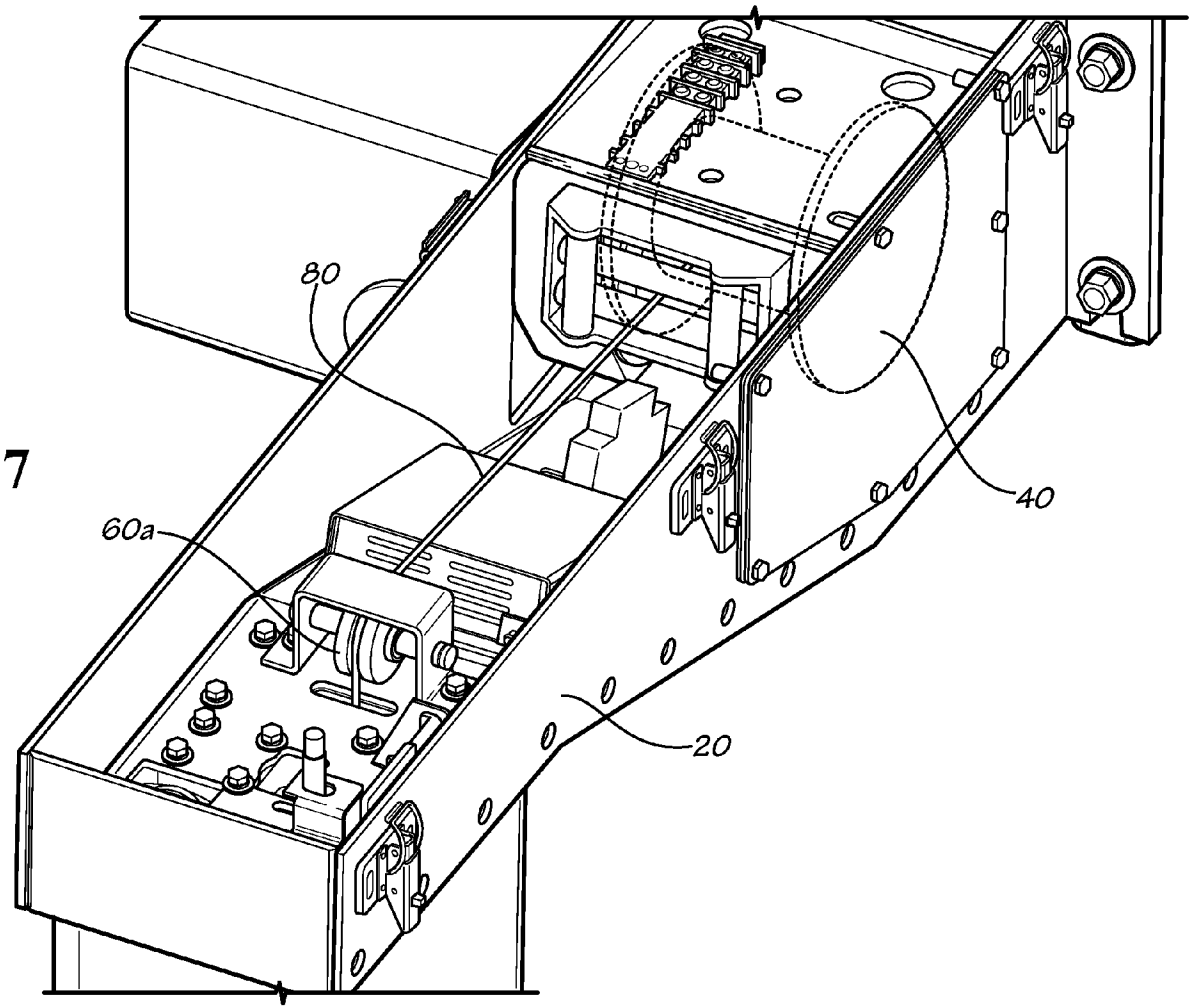
FIG. 7 shows a cutaway perspective view of an alternative upper pulley arrangement of an elevated support system according to an example form of the present invention.
Figure 8:
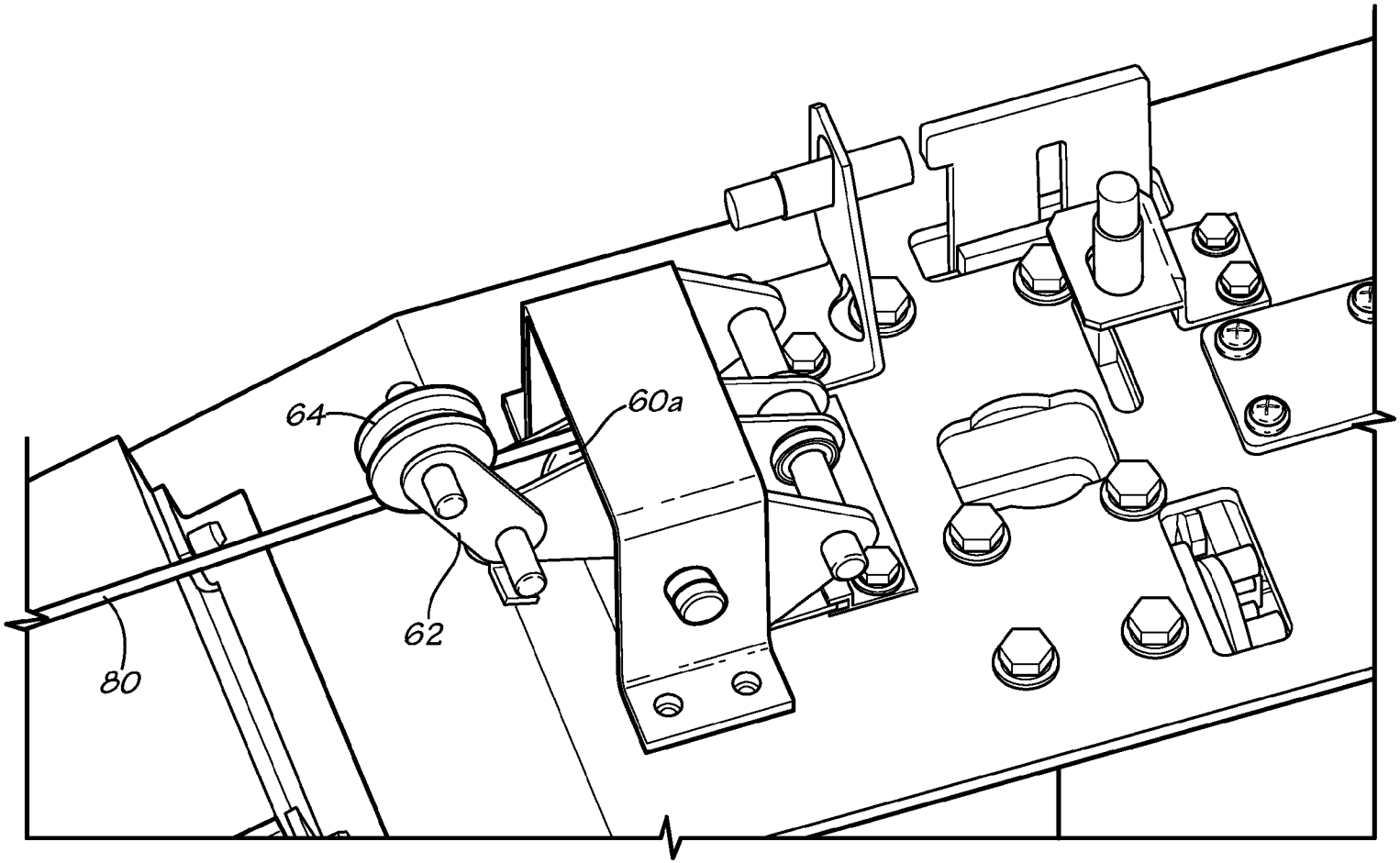
FIG. 8 shows a perspective view of an alternative upper pulley arrangement including a cable tensioning arm, according to an example form of the present invention.
Figure 9:
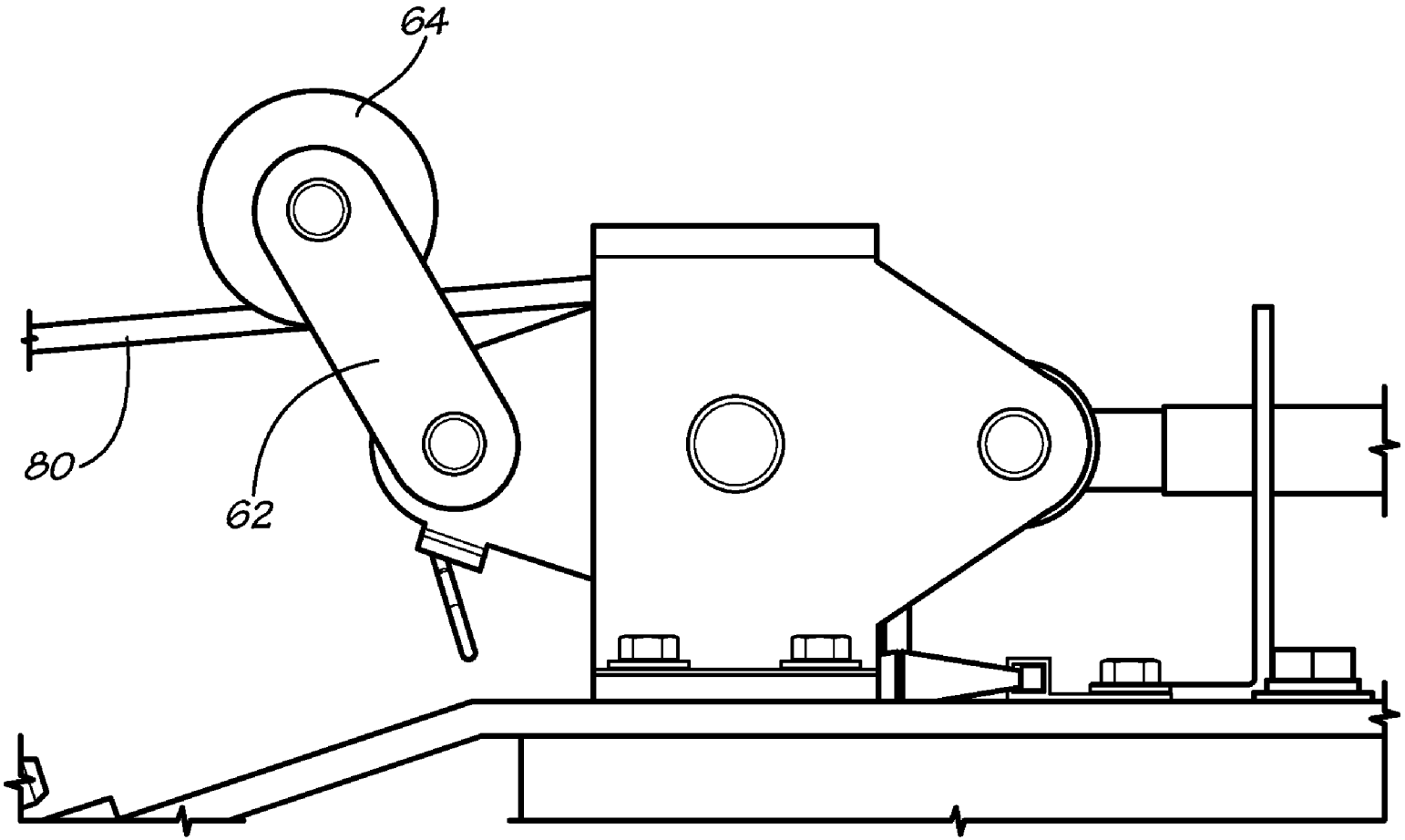
FIG. 9 shows a detailed side view of the upper pulley arrangement shown in FIG. 8.

In an alternative embodiment, the upper pulley 60*a* is translationally mounted to slide back and forth on an axle, transverse to the length of the cable, as shown in FIG. 7, such that the pulley can slide freely from side to side as the cable 80 is wound and unwound to better align with the position of the cable on the spool of the winch and reduce twisting stresses or wear in the pulley and mounting bracket. In this embodiment, a single continuous length of cable or wire 80 extends from a first end connected to the winch 40, with a medial portion running over the upper pulley and through the lower pulleys, to a second end affixed to the arm body 20. In alternate forms of the invention, two or more cables or wires are provided. Optionally the upper pulley 60*a* can be pivotally mounted on a swivel coupling, allowing the pulley to remain aligned with the cable as it moves from side to side when it is wound onto and unwound from the reel of the winch, thereby reducing strain on the equipment. Optionally, a tensioning arm 62 having an idler pulley 64 is provided between the winch 40 and the upper pulley 60*a*, as seen in example form in FIGS. 8-9, to maintain a steady tension on the cable and reduce or eliminate loose windings and/or cable tangling on the winch spool.

While the invention has been described with reference to certain depicted and example embodiments, it will be understood by those skilled in the art that a variety of modifications, additions and deletions are within the scope of the invention, as defined by the following claims.

What is claimed is:

1. A system for raising and lowering equipment, said system comprising:

a fixed support arm for attachment to an elevated support structure, a movable carriage for carrying the equipment, a cable extending between the fixed support arm and the movable carriage, a winch for selectively spooling and unspoolinq the cable to raise and lower the movable carriage relative to the fixed support arm, first electrical contacts mounted to the support arm and second electrical contacts mounted to the carriage, the first and second electrical contacts engaging with one another to allow operation of the equipment when the carriage moves into a raised position, and releasing from one another as the carriage moves from the raised position toward a lowered position.

2. The system of claim 1, wherein the equipment comprises a surveillance camera housing mounted to the movable carriage.

3. The system of claim 1, further comprising a pulley system for carrying the cable.

4. The system of claim 3, wherein the pulley system comprises at least one upper pulley mounted to the support arm and at least one lower pulley mounted to the carriage.

5. The system of claim 1, wherein the winch is a powered winch, and further comprising a control station for remotely operating the powered winch.

6. A system for raising and lowering equipment, said system comprising:

a fixed support arm for attachment to an elevated support structure, a movable carriage for carrying the equipment, a cable extending between the fixed support arm and the movable carriage, a winch for selectively spooling and unspoolinq the cable to raise and lower the movable carriage relative to the fixed support arm, wherein the cable is spooled over a pulley system to define a dual cable path comprising two cable segments spaced a horizontal distance from one another, wherein the pulley system comprises an upper pulley that is pivotally mounted to the support arm.

7. A system for raising and lowering equipment, said system comprising:

a fixed support arm for attachment to an elevated support structure, a movable carriage for carrying the equipment, a cable extending between the fixed support arm and the movable carriage, a winch for selectively spooling and unspooling the cable to raise and lower the movable carriage relative to the fixed support arm, wherein the cable is spooled over a pulley system to define a dual cable path comprising two cable segments spaced a horizontal distance from one another, wherein the pulley system comprises an upper pulley that is translationally mounted to slide back and forth on an axle.

8. A system for raising and lowering equipment, said system comprising:

a fixed support arm for attachment to an elevated support structure, a movable carriage for carrying the equipment, a cable extending between the fixed support arm and the movable carriage, a winch for selectively spooling and unspooling the cable to raise and lower the movable carriage relative to the fixed support arm, an end-of-spool sensor mechanism comprising a pivotally mounted arm operatively engaged with the cable spooled on the winch, and an actuator for shutting down the winch when the pivotally mounted arm moves into a position indicating nearly all of the cable has unspooled from the winch.

9. The system of claim 8, further comprising an overload/unspooling mechanism, the overload/unspooling mechanism comprising a pivotally mounted member, wherein the cable is connected to the pivotally mounted member and causes the pivotally mounted member to pivot in a first direction when overloaded, to shut down the winch.

10. The system of claim 9, wherein the pivotally mounted member pivots in a second direction when under-loaded, to shut down the winch.

11. An elevated support mechanism comprising a carriage, a winch, a cable coupled to the carriage and the winch, and an end-of-spool shut-off mechanism for deactivating the winch when nearly all of the cable is unspooled from the winch.

12. An elevated support system for a surveillance camera, comprising:

a support arm having a winch mounted thereto for raising and lowering the surveillance camera, a first upper pulley, an upper electrical contact, and an upper alignment guide member;

a carriage for mounting the surveillance camera to, and comprising at least one lower pulley, a lower electrical contact for cooperative engagement and disengagement with the upper electrical contact of the support arm, and a lower alignment guide member for cooperative engagement and disengagement with the upper alignment guide member;

a cable having a first end spooled onto the winch, extending over the first upper pulley, downward and around the at least one lower pulley, and back up to a second end affixed to the support arm.

13. The elevated support system of claim 12, further comprising a second upper pulley mounted to the support arm, and wherein the cable passes from the at least one lower pulley, over the second upper pulley, to the second end affixed to the support arm.

14. The elevated support system of claim 13, wherein the second end of the cable is affixed to a bracket pivotally mounted to the support arm, and wherein movement of the pivotal bracket away from a neutral position deactivates the winch.

15. The elevated support system of claim 12, further comprising a latch mechanism for securing and releasing the carriage to and from the support arm at an elevated position.

16. The elevated support system of claim 15, wherein the latch mechanism comprises a carriage locking arm attached to the carriage and having an opening therethrough, and further comprises a locking member mounted to the support arm and sliding into and out of engagement with the opening in the carriage locking arm.

17. The elevated support system of claim 16, wherein the latch mechanism further comprises a cam for advancing and retracting the locking member and a pawl for actuating the cam.

18. The elevated support system of claim 12, further comprising an end-of-spool sensor mechanism for deactivating the winch before the cable completely unspools therefrom.

19. The elevated support system of claim 12, further comprising a surveillance camera mounted to the carriage and electrically connected to the lower electrical contact.

* * * * *